US009105238B2

(12) United States Patent
Hekmatshoartabari et al.

(10) Patent No.: US 9,105,238 B2
(45) Date of Patent: Aug. 11, 2015

(54) ACTIVE MATRIX TRIODE SWITCH DRIVER CIRCUIT

(71) Applicant: International Business Machines Corporation, Armonk, NY (US)

(72) Inventors: Bahman Hekmatshoartabari, White Plains, NY (US); Davood Shahrjerdi, White Plains, NY (US)

(73) Assignee: International Business Machines Corporation, Armonk, NY (US)

( * ) Notice: Subject to any disclaimer, the term of this patent is extended or adjusted under 35 U.S.C. 154(b) by 197 days.

(21) Appl. No.: 13/870,400

(22) Filed: Apr. 25, 2013

(65) Prior Publication Data

US 2014/0320541 A1 Oct. 30, 2014

(51) Int. Cl.
*G09G 3/30* (2006.01)
*G09G 3/32* (2006.01)

(52) U.S. Cl.
CPC ..... *G09G 3/3258* (2013.01); *G09G 2300/088* (2013.01); *G09G 2300/0842* (2013.01)

(58) Field of Classification Search
CPC ..... G09G 3/3258; G09G 2300/088; G09G 2300/0842
USPC ..... 345/76
See application file for complete search history.

(56) References Cited

U.S. PATENT DOCUMENTS

| | | | | |
|---|---|---|---|---|
| 6,351,078 | B1 * | 2/2002 | Wang et al. | 315/169.3 |
| 8,188,673 | B2 * | 5/2012 | Hente et al. | 315/247 |
| 2002/0063683 | A1 * | 5/2002 | Yi et al. | 345/156 |
| 2002/0080637 | A1 * | 6/2002 | Yi et al. | 363/147 |
| 2005/0110725 | A1 * | 5/2005 | Kwak et al. | 345/76 |
| 2006/0007071 | A1 * | 1/2006 | Yamazaki et al. | 345/76 |

* cited by examiner

*Primary Examiner* — Kwang-su Yang
(74) *Attorney, Agent, or Firm* — Jeff Tang; Ryan, Mason & Lewis, LLP

(57) ABSTRACT

A pixel circuit for an active matrix organic light-emitting diode display system includes a first input node, a second input node, first power supply node, a second power supply node, a triode switch circuit, a storage capacitor, an organic light emitting diode, and a resistive element. The triode switch circuit is connected to the first and second input nodes. The storage capacitor is connected between an output of the triode switch circuit and the second power supply node. The organic light-emitting diode is connected between the output of the triode switch circuit and the second power supply node. The first resistive element is connected between the output of the triode switch circuit and the first power supply node.

6 Claims, 4 Drawing Sheets

ACTIVE MATRIX TRIODE SWITCH DRIVER CIRCUIT

TECHNICAL FIELD

The field relates generally to organic light-emitting diode (OLED) displays, and more specifically, to circuits and methods for driving OLED pixel displays using active matrix triode switch driver circuits.

BACKGROUND

In general, various types of display devices are used for computer and video systems including, for example, LCD (liquid crystal display) devices and LED (light emitting diode) display devices. A typical display device comprises a number of display elements or "pixels" arranged in rows and columns to form a matrix on a glass substrate. Active matrix backplanes, such as those used for driving OLED displays, typically include thin-film transistor (TFT) devices in the pixel circuitry, which operate as switching and driving components. An OLED generates light in response to current flow through an organic compound which is fluorescent or phosphorescent and excited by electron-hole recombination. Some known active-type OLED configurations incorporate two, three and four TFTs per pixel (2-TFT, 3-TFT, 4-TFT). A TFT-based OLED uses a TFT to control the amount of current flowing through the OLED based on data signals corresponding to a displayed image, which are received by the TFT. There are various disadvantages to active TFT-based OLED displays.

For example, the cost of the TFT backplane is a significant portion of the total display including the frontplane and packaging. Indeed, TFT backplanes are typically formed of low temperature poly silicon TFTs that are capable of delivering a large current and therefore, yielding a bright display. However, the poly silicon TFT fabrication process is expensive and complex as it requires many (e.g., nine) photoengraving process (PEP) steps to manufacture the TFTs. Moreover, the operation of the TFTs that drive an OLED can change over time, resulting in lack of uniformity of the current used to drive the OLED. For example, the threshold voltages of TFTs can vary over time due to electrical stress that is induced when driving OLED devices, as well as other factors or conditions that can temporarily or permanently change the threshold voltages of the TFTs. Since an OLED is a current-driven element in which the luminance depends on the amount of current flowing through the OLED, if the driving TFTs do not supply a uniform current, or if the driving current changes with time, the resultant image generated by the OLED display will degrade. For example, an increase in the threshold voltage of a driving TFT causes less current to pass through the OLED, thereby decreasing the brightness of the OLED.

SUMMARY

Embodiments of the invention generally include pixel circuits for organic light-emitting diode (OLED) displays, and circuits and methods for implementing active matrix triode switch circuits for driving OLED display systems.

In one embodiment, a pixel circuit includes a first input node, a second input node, first power supply node, a second power supply node, a triode switch circuit, a storage capacitor, an organic light emitting diode, and a resistive element. The triode switch circuit is connected to the first and second input nodes. The storage capacitor is connected between an output of the triode switch circuit and the second power supply node. The organic light-emitting diode is connected between the output of the triode switch circuit and the second power supply node. The first resistive element is connected between the output of the triode switch circuit and the first power supply node.

In another embodiment of the invention, an active matrix display system includes a control circuit, a scanning circuit, a hold circuit, a plurality of pixel circuits forming an m×n pixel array, n row select lines connected to the scanning circuit, wherein each row of pixels in the pixel array is connected to a same row select line, and m data lines connected to the hold circuit, wherein each column of pixels in the pixel array is connected to a same data line. Each pixel circuit includes a first input node connected to a data line, a second input node connected to a row select line, first power supply node, a second power supply node, a triode switch circuit connected to the first and second input nodes, a storage capacitor connected between an output of the triode switch circuit and the second power supply node, an organic light-emitting diode connected between the output of the triode switch circuit and the second power supply node, and a first resistive element connected between the output of the triode switch circuit and the first power supply node.

In yet another embodiment of the invention, a method is provided for operating a pixel circuit for an active matrix display system. The method includes initiating a programming period of the pixel circuit by activating a triode switch circuit of the pixel circuit to transfer a programming data voltage on a data line of the display system to a storage capacitor of the pixel circuit during the programming period, and initiating an illumination period of the pixel circuit by deactivating the triode switch circuit of the pixel circuit to isolate the storage capacitor from the data line and charge the storage capacitor from the programming data voltage to a voltage that turns on an organic light emitting diode during the illumination period of the pixel circuit.

Other embodiments of the invention will become apparent from the following detailed description, which is to be read in conjunction with the accompanying drawings.

DETAILED DESCRIPTION

Figure 1:
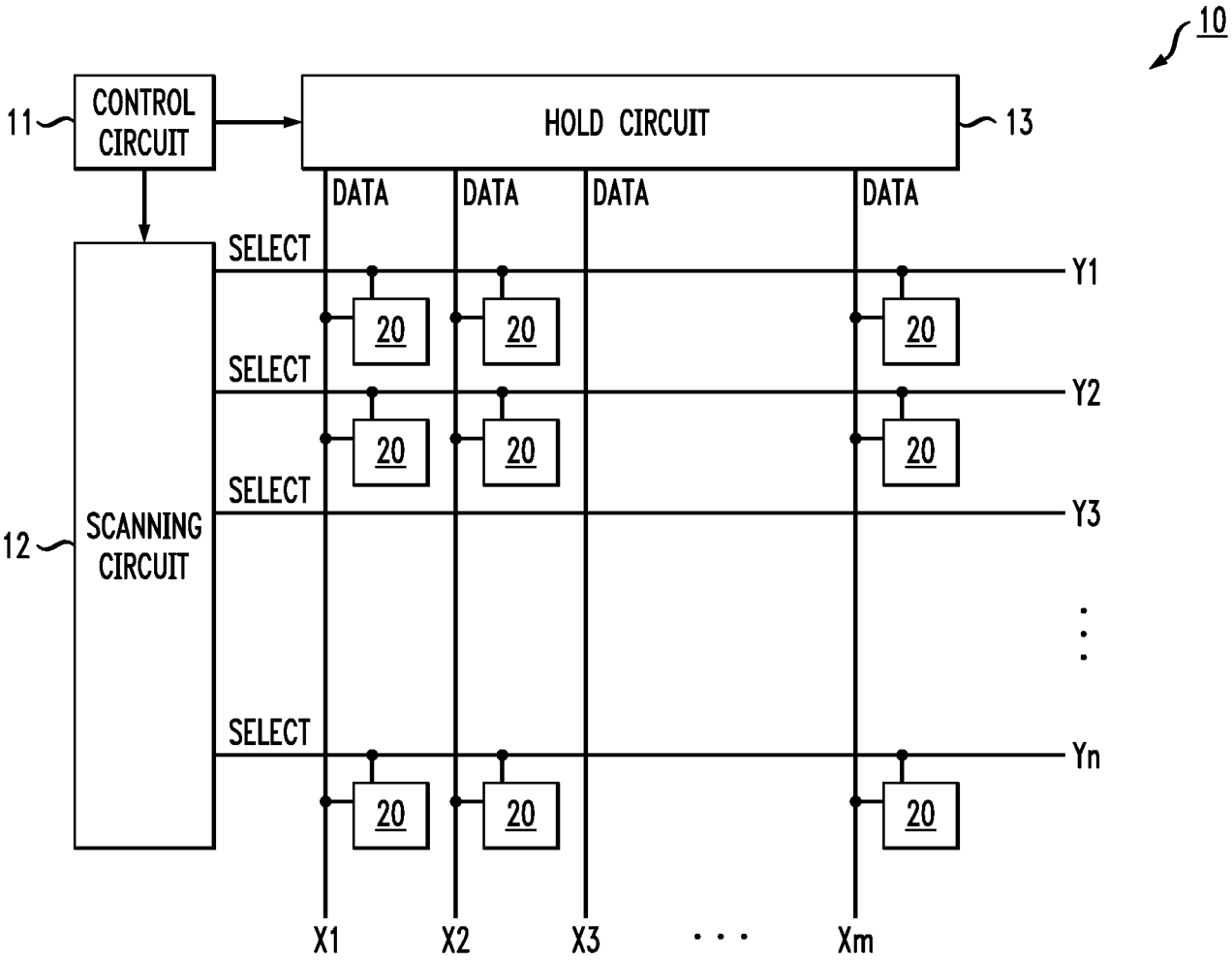
FIG. 1 is a schematic diagram of an active-matrix OLED display system to which embodiments of the invention are applied.

Embodiments of the invention will now be described in further detail with regard to organic light-emitting diode (OLED) displays, and more specifically, to circuits and methods for driving OLED displays using active matrix triode switch driver circuits. FIG. 1 schematically illustrates an active-matrix OLED display system to which embodiments of the invention are applied. In general, FIG. 1 illustrates an OLED display system 10 comprising a control circuit 11, a scanning circuit 12, a hold circuit 13, and a plurality of pixel circuits 20 (or pixels) forming an m×n pixel array for an active-matrix display panel. The active-matrix OLED display system 10 comprises a plurality (n) of SELECT (row) lines (Y1, Y2, Y3, . . . , Yn) connected to the scanning circuit 12, wherein each row of pixels 20 is connected to the same SELECT line. The active-matrix OLED display system 10 further comprises a plurality (m) of DATA lines (X1, X2, X3, . . . , Xm) connected to the hold circuit 13, wherein each column of pixels 20 is connected to the same DATA line.

The control circuit 11 receives and processes a video signal, and outputs controls signals to the scanning circuit 12 and hold circuit 13 to drive the active-matrix pixel array and generate an image for each frame of image data in the video signal. In particular, in response to control signals output from the control circuit 11, the hold circuit 13 outputs respective data signals to each of the m DATA lines (X1, X2, X3, . . . , Xm). Moreover, in response to control signals output from the control circuit 11, the scanning circuit 12 generates scan control signals to sequentially drive the n SELECT lines (Y1, Y2, Y3, . . . , Yn) and activate each row of pixels in sequence. An operating mode of the active-matrix OLED display system 10 of FIG. 1 will be discussed in further detail below with reference to FIG. 4, for example.

Figure 2:
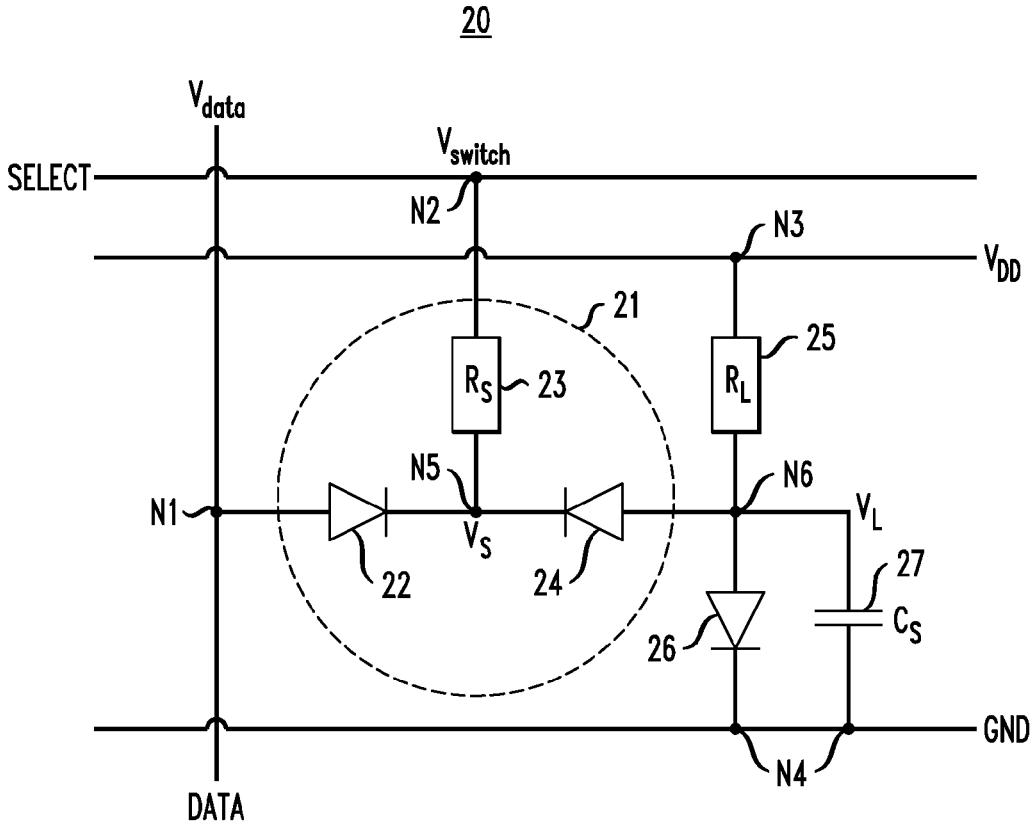
FIG. 2 is a schematic circuit diagram of a pixel circuit of an active-matrix OLED display system according to an embodiment of the invention.

In contrast to conventional TFT-based OLED pixel circuits as discussed above, each pixel circuit 20 shown in FIG. 1 implements an active matrix triode switch driver circuit (or "triode switch circuit") to drive an OLED element. For example, FIG. 2 is a schematic circuit diagram of a pixel circuit of an active-matrix OLED display system according to an embodiment of the invention. In particular, FIG. 2 shows an embodiment of a pixel circuit 20 for implementing the pixel array in the active-matrix OLED display system 10 of FIG. 1, according to an embodiment of the invention. As shown in FIG. 2, the pixel circuit 20 comprises a first node N1 connected to a DATA line, a second node N2 connected to a SELECT line, a third node N3 connected to a first power supply line (e.g., VDD), and a fourth node N4 connected to a second power supply line (e.g., GND). The pixel circuit 20 further comprises a triode switch circuit 21 comprising a first diode 22, a first resistor 23 having a resistance $R_S$, and a second diode 24. The first diode 22 has an anode connected to the first node N1 and a cathode connected to a fifth node N5. The second diode 24 has a cathode connected to the fifth node N5 and an anode connected to a sixth node N6. The first resistor 23 is connected between the second node N2 and the fifth node N5. The first and second nodes N1 and N2 may be considered input nodes of the pixel circuit 20 and the sixth node N6 may be considered an output node of the triode switch circuit 21.

The pixel circuit 20 further comprises a second resistor 25 having a resistance $R_L$, an organic light emitting diode (OLED) 26, and a storage capacitor 27 having a capacitance $C_S$. The second resistor 25 is connected between the third node N3 and the sixth node N6. The OLED 26 has an anode connected to the sixth node N6 and a cathode connected to the fourth node N4. The storage capacitor 27 is connected between the fourth and sixth nodes N4 and N6. The storage capacitor 27 stores voltages for controlling the operation of the OLED 26 during programming and illumination periods of operation of the pixel circuit 20, as described below.

Figure 3:
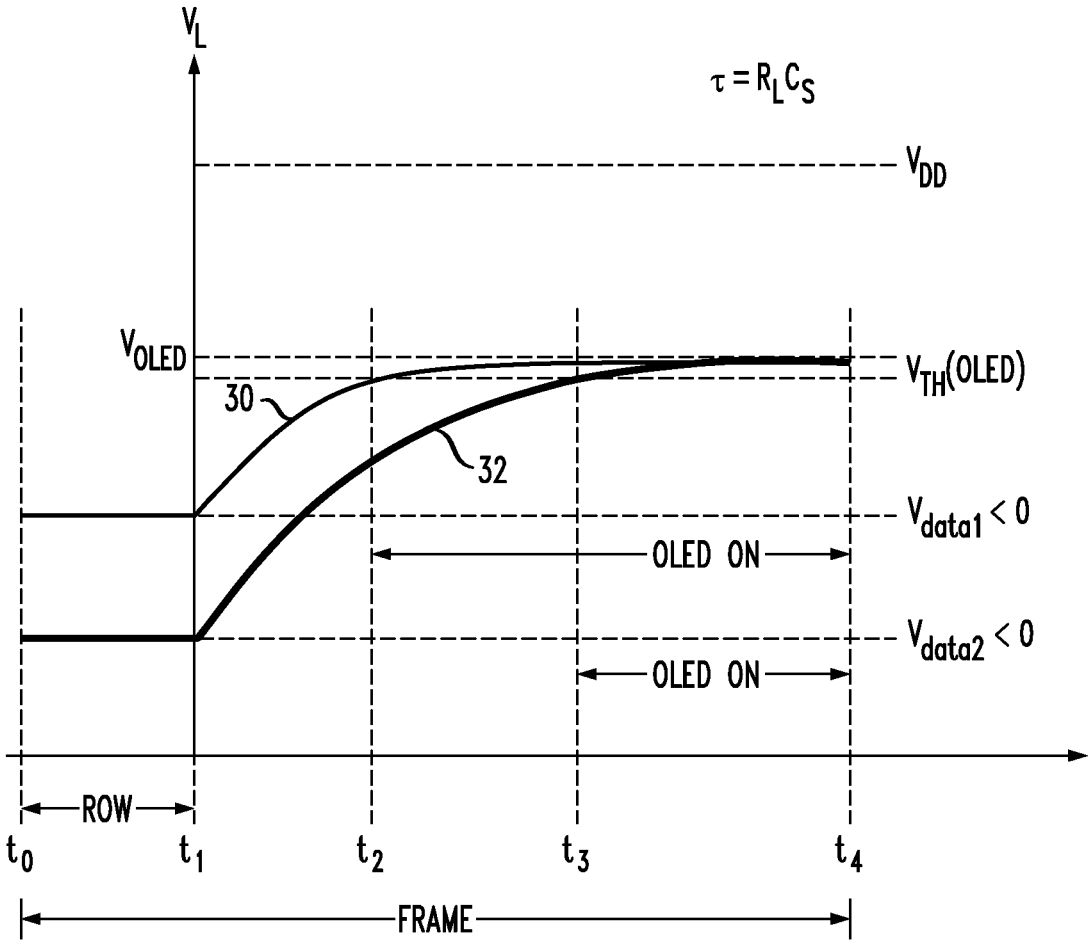
FIG. 3 is a timing diagram illustrating operating modes of a pixel circuit of an active-matrix OLED display according to an embodiment of the invention.
Figure 4:
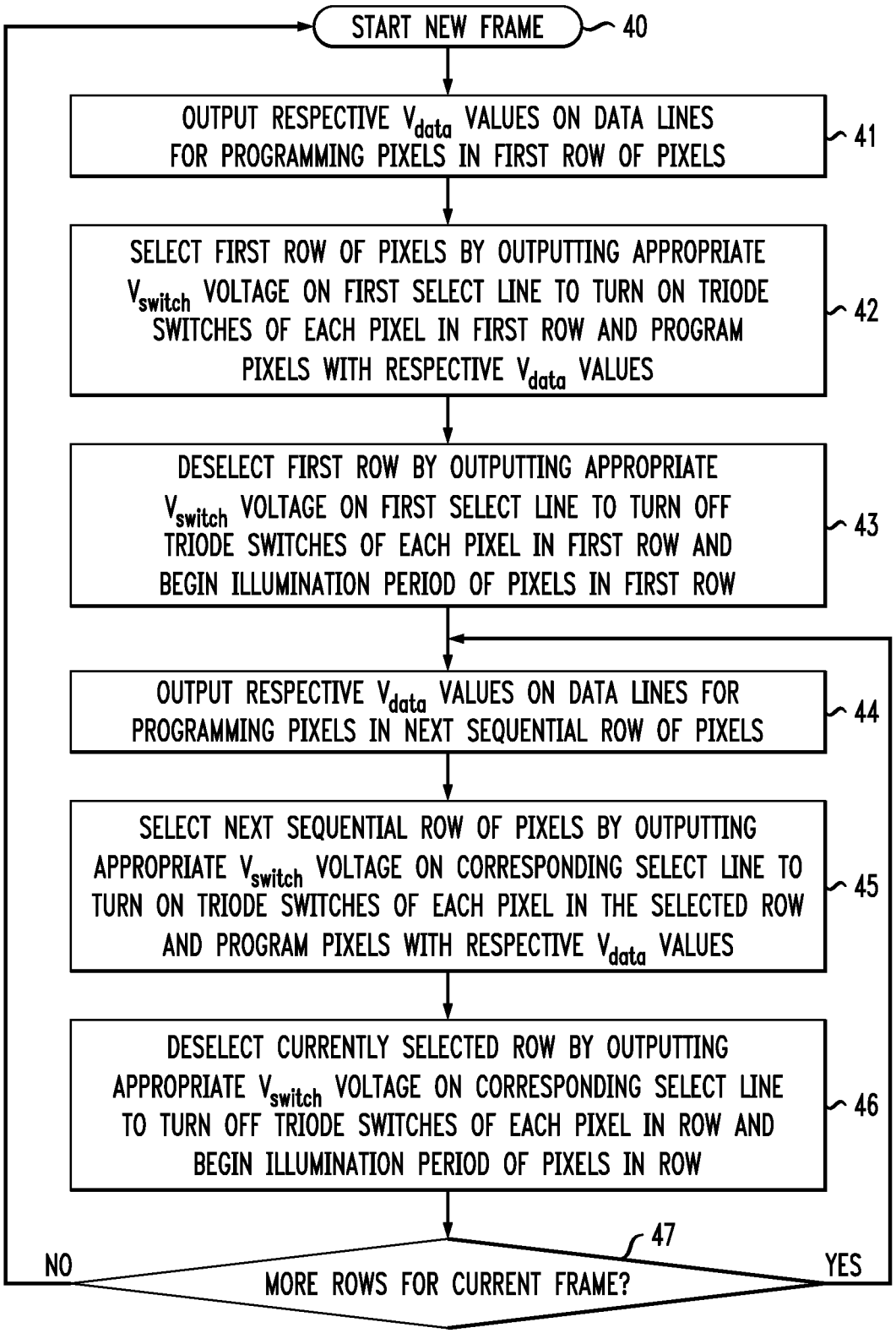
FIG. 4 is a flow diagram illustrating a method of operating an active-matrix OLED display system according to an embodiment of the invention.

In contrast to conventional TFT-based pixel circuits as discussed above, the pixel circuit 20 shown in FIG. 2 uses diodes, in particular, the triode switch 21, to drive the OLED element 26 (or other current driven devices) in an active-matrix OLED display system according to an embodiment of the invention. In one embodiment of the invention, control voltages are applied to the DATA and SELECT lines to implement time-sequential programming of the pixel circuit 20 in the active-matrix OLED display system 10 of FIG. 1, wherein the illumination time of the OLED 26 is modulated by a percentage of time that the OLED 26 is "ON" during a "frame time" or "frame period," based on the magnitude of the programming voltage $V_{data}$ that is initially applied to the node N6 during a programming period. FIGS. 3 and 4 illustrate a time-sequential programming mode of operation of the pixel circuit 20 of FIG. 2 in the active-matrix OLED display system 10 of FIG. 1.

In particular, FIG. 3 is a timing diagram illustrating operating modes of a pixel circuit 20 in an active-matrix OLED display 10 of FIG. 1 according to an embodiment of the invention. FIG. 3 graphically illustrates the voltage $V_L$ on node N6 of a given pixel circuit 20 as a function of time over one "frame period" (i.e., from time $t_0$ to $t_4$). The frame period includes a programming (or row) period (i.e., from time $t_0$ to $t_1$) and an illumination period (i.e., from time $t_1$ to $t_4$). In general, during a programming period of operation of the pixel circuit 20, the triode switch circuit 21 is activated (turned on) to transfer a voltage $V_{data}$ on node N1 (DATA line) to node N6, wherein the voltage $V_{data}$ is stored by the storage capacitor 27. For comparison purposes, FIG. 3 shows two voltage waveforms 30 and 32 for the voltage VL at node N6 of the pixel circuit 20, each having a different initial programming voltage level $V_{data1}$ and $V_{data2}$, respectively, wherein $V_{data1}$ and $V_{data2}$ are negative values (<0V) but wherein $V_{data2}$ is less (more negative) than $V_{data1}$.

More specifically, during an initial programming period for a given pixel circuit 20, a voltage $V_{data}$ applied to a given DATA line is input to the given pixel circuit 20 at node N1. In one embodiment of the invention, the voltage $V_{data}$ is set to a given negative voltage level with respect to a voltage level of the second power supply node (e.g., less than 0V when the second power supply node is set to a ground (GND) voltage of 0V) in a predetermined range of negative voltage levels that correspond to different gray scale levels. During the programming period, a voltage $V_{switch}$ is applied to the SELECT line connected to the given pixel circuit 20, wherein the voltage $V_{switch}$ is set to a voltage level that is lower than a lowest $V_{data}$ corresponding to a brightest gray scale level for the pixels.

During the programming period, since $V_{switch}$ is more negative than $V_{data}$, the diodes 22 and 24 of the triode switch circuit 21 are both turned on (i.e., the triode switch circuit 21 is turned on) and the voltages $V_S$ and $V_L$ at respective nodes N5 and N6 are both charged to $V_{data}$ (<0). In other words, in the programming period, the triode switch circuit 21 is turned on thereby transferring the voltage $V_{data}$ at the input node N1 to the output node N6 of the triode switch circuit 21, whereby the storage capacitor 27 is charged to the negative programming voltage $V_{data}$. In the programming period, since the diode 24 is connected to the first power supply line VDD at node N3 through the resistor 25, the diode 24 is in an ON state. However, since the voltage VL at node N6 is negative, the OLED 26 is in an OFF state.

It should be noted that in the above description, for simplicity, it is assumed that the ON-state voltage drop across the diodes 22 and 24 is negligible. In practice, however, the ON-state voltage drop is non-zero (about 700 mV for Si p-n junction diodes and typically in the range of 200-400 mV for Si Schottky diodes). Assume that the values of ON-state voltage drop across the diodes 22 and 24 are denoted as $V_{ON}$ (22) and $V_{ON}$ (24), respectively. In the programming period, the voltage ($V_{data}$) transferred from the input node N1 to nodes N5 and N6 would actually be $V_{data}-V_{ON}$ (22) and $V_{data}-V_{ON}$ (22)+$V_{ON}$ (24), respectively. In typical implementations of integrated circuits, the ON-state voltage drop across the diodes 22 and 24 are expected to be substantially the same and, therefore, the voltage transferred to node N6 will be substantially equal to the voltage $V_{data}$ on node N1.

Next, at the start of an illumination period (starting at time $t_1$), the triode switch circuit 21 is deactivated (turned off), thereby isolating node N6 from the DATA line (node N1). In particular, at the end of the programming period, the voltage $V_{switch}$ on the SELECT line is set to a value that is greater than an operating voltage ($V_{OLED}$) of the OLED 26. For example, in one embodiment of the invention, the voltage $V_{switch}$ is set to VDD. Therefore, both diodes 22 and 24 of the triode switch circuit 21 will be reversed-biased (OFF state) until the end of the frame period (when a new programming period is commenced). In the Off state of the triode switch circuit 21, the OLED 26 will be isolated from the input node N1 and another programming voltage $V_{data}$ can be applied to the DATA line to program a pixel circuit in a different row of pixels.

With the node N6 isolated from the input node N1, as shown in FIG. 3, at the start of the illumination period (at time $t_1$), the voltage $V_L$ on node N6 begins to exponentially charge up to the operating voltage $V_{OLED}$ of the OLED 26, where the operating voltage $V_{OLED}$ of the OLED 26 is typically slightly larger than a threshold voltage ($V_{th}$ (OLED)) of the OLED 26. In particular, in the pixel circuit 20 shown in FIG. 2, with the node N6 isolated from the input node N1, the resistor 25 and the storage capacitor 27 provide an RC circuit connected between power supply nodes N3 and N4 (e.g., VDD and GND), which causes voltage VL on node N6 to exponentially increase from the initial negative programming voltage $V_{data}$ with a charge time that depends on the RC delay of the circuit based on the respective values of $R_L$ and $C_S$ of the resistor 25 and the storage capacitor 27 (i.e., $\tau=R_LC_S$).

The voltage $V_L$ on node N6 will exponentially increase until the voltage $V_L$ reaches the threshold voltage $V_{th}$ of the OLED 26, in which case the OLED 26 is turned ON. Once the voltage $V_L$ on node N6 reaches the threshold voltage $V_{th}$ of the OLED 26, the OLED 26 starts illuminating, and the voltage $V_L$ on node N6 will slightly increase to a steady state operating voltage $V_{OLED}$ of the OLED 26. The current that flows through the OLED 26 in the steady state is determined as $(V_{DD}-V_{OLED})/R_L$.

In this operating paradigm, the brightness of a given pixel circuit 20 is determined time-sequentially, wherein an average brightness of the given pixel circuit 20 is determined as a fraction of the time that the OLED 26 is "ON" during the frame period. In particular, the brightness of a given pixel circuit 20 is determined time-sequentially, i.e., the ratio of the time period that the OLED 26 is illuminating to the frame period, times the maximum OLED brightness (which is the brightness corresponding to the steady state OLED current of $(V_{DD}-V_{OLED})/R_L$)). In the pixel circuit 20 of FIG. 2, the "ON" time of the OLED 26 is increased by increasing the level of the programming voltage $V_{data}$ that is applied to the storage capacitor 27 during the programming period. For instance, as shown in FIG. 3, in response to the $V_L$ voltage waveform 30, the OLED 26 has an "ON" period from time $t_2$-$t_4$, whereas in response to the $V_L$ voltage waveform 32, the OLED 26 has a shorter "ON" period from time $t_3$-$t_4$. This is because the $V_L$ voltage waveform 32 begins with an initial programming voltage $V_{data2}$ that is less (more negative) than the initial programming voltage $V_{data1}$ of the $V_L$ voltage waveform 30, such that is takes longer to charge the node N6 to the threshold voltage of the OLED 26. It is to be appreciated that in some embodiments, applying a negative voltage across the OLED 26 during the initial programming period serves to reduce drifting of the OLED threshold voltage in the course of operation.

FIG. 4 is a flow diagram illustrating a method of operating an active-matrix OLED display system according to an embodiment of the invention. In particular, FIG. 4 illustrates a method of operating the active-matrix OLED display system 10 of FIG. 1 within an array of pixels having the pixel circuit framework shown in FIG. 2. Beginning with a new frame of image data processed by the control circuit 11 (block 40), the hold circuit 13 will output respective $V_{data}$ values on the DATA lines (X1, X2, X3, . . . , Xm) for programming the pixel circuits 20 in the first row Y1 of pixels 20 (block 41). Next, the pixel circuits 20 in the first row Y1 of pixels are programmed by the scanning circuit 12 outputting an appropriate voltage $V_{switch}$ to the first SELECT line Y1 to activate the triode switch circuits 21 in each pixel circuit 20 in the first row of pixels, and program the pixels with the respective $V_{data}$ values applied on the respective DATA lines (block 42), such as discussed above with reference to FIGS. 2 and 3. At the end of the period for programming the first row of pixels, the first SELECT line Y1 is deactivated (by applying an appropriate voltage $V_{switch}$ (e.g. VDD) on the SELECT line) to turn "OFF" the triode switch circuit 21 in each of the pixel circuits 20 in the first row of pixels and begin the illumination period of the pixel circuits for the remaining time of the frame period for the first row of pixels (block 43). As discussed above, during the illumination period, each pixel will have a brightness that is based on a level of the initial programming voltage $V_{data}$ applied to that pixel during the programming period.

Next, during the illumination period of the first row of pixels, the hold circuit 13 will output respective $V_{data}$ values on the DATA lines (X1, X2, X3, . . . , Xm) for programming the pixel circuits 20 in the next sequential row of pixels (e.g., second row following first row) (block 44) based on control signals output from the control circuit 11. To program the pixel circuits 20 in the next sequential row pixels, the row of pixels is selected by operation of the scanning circuit 12 outputting the appropriate voltage $V_{switch}$ to the corresponding SELECT line to activate the triode switch circuits 21 in each of the pixels 20 in the selected row of pixels and program the pixels with the respective $V_{data}$ values applied on the respective DATA lines (block 45), such as discussed above with reference to FIGS. 2 and 3. At the end of the programming period for programming the currently selected row of pixels, the currently selected row of pixels is deselected by applying the appropriate voltage $V_{switch}$ (e.g., VDD) on the SELECT line to turn "OFF" the triode switch circuit 21 in each of the pixel circuits 20 of the given row and begin the illumination period of the pixel circuits for the remaining time of the frame period for that row of pixels (block 46).

If more rows exist for the current frame (affirmative determination in block 47), the display process of blocks 44, 45 and 46 are repeated for each remaining row in the current frame. Once the current frame has been fully processed and displayed (negative result in block 47), the process of FIG. 4 is repeated for the next new frame (return to block 40). In one embodiment of the invention, for a QVGA application, the display system 10 of FIG. 1 can have 256 rows of pixels, wherein the programming period for the pixels in each row of pixels is about 64 μs and the frame time is about 16 ms (wherein 64μ×256≅16 ms).

It is to be understood that the control circuitry, the scanning circuitry, and the hold circuitry shown in FIG. 1 may be implemented as integrated circuits with various analog and digital circuitry. In particular, integrated circuit dies can be fabricated having semiconductor structures and devices such as a field-effect transistors, bipolar transistors, metal-oxide-semiconductor transistors, diodes, resistors, capacitors, inductors, etc., forming analog and/or digital circuits, in which various control circuits may be employed for controlling operation of an active matrix display system. Given the teachings of the invention provided herein, one of ordinary skill in the art will be able to contemplate other implementations and applications of embodiments of the invention.

Although embodiments of the invention have been described herein with reference to the accompanying figures, it is to be understood that the invention is not limited to those precise embodiments, and that various other changes and modifications may be made therein by one skilled in the art without departing from the scope of the appended claims.

What is claimed is:

1. A pixel circuit, comprising:

a first input node, a second input node, a first power supply node, and a second power supply node;

a triode switch circuit connected to the first and second input nodes;

a storage capacitor connected between an output of the triode switch circuit and the second power supply node;

an organic light-emitting diode connected between the output of the triode switch circuit and the second power supply node; and a first resistive element connected between the output of the triode switch circuit and the first power supply node, wherein the triode switch circuit comprises a second resistive element and at most two diodes comprising a first diode, and a second diode, wherein an anode of the first diode is connected to the first input node, wherein a cathode of the first diode is connected to a cathode of the second diode, wherein an anode of the second diode is connected to the output of the triode switch circuit, wherein the cathode of the first diode and the cathode of the second diode are connected to the second input node of the pixel circuit through the second resistive element, and wherein the storage capacitor and the first resistive element are serially connected between the first and second power supply nodes and are configured as an RC charging circuit to charge a voltage on the output node of the triode switch circuit when both the first and second diodes of the triode switch circuit are in a reversed-bias state.

2. The pixel circuit of claim 1, wherein the first input node of the pixel circuit is connected to a data line of a display system.

3. The pixel circuit of claim 1, wherein the second input node of the pixel circuit is connected to a row select line of a display system.

4. A display system comprising an array of pixels, wherein each pixel in the array of pixels comprises the pixel circuit of claim 1.

5. An active matrix display system, comprising:

a control circuit;

a scanning circuit;

a hold circuit;

a plurality of pixel circuits forming an m×n pixel array;

n row select lines connected to the scanning circuit, wherein each row of pixels in the pixel array is connected to a same row select line, wherein n is an integer greater than 1; and m data lines connected to the hold circuit, wherein each column of pixels in the pixel array is connected to a same data line, wherein m is an integer greater than 1, wherein each pixel circuit comprises:

a first input node connected to a data line, a second input node connected to a row select line, a first power supply node, and a second power supply node;

a triode switch circuit connected to the first and second input nodes;

a storage capacitor connected between an output of the triode switch circuit and the second power supply node;

an organic light-emitting diode connected between the output of the triode switch circuit and the second power supply node; and a first resistive element connected between the output of the triode switch circuit and the first power supply node, wherein the triode switch circuit comprises a second resistive element and at most two diodes comprising a first diode, and a second diode, wherein an anode of the first diode is connected to the first input node wherein a cathode of the first diode is connected to a cathode of the second diode, wherein an anode of the second diode is connected to the output of the triode switch circuit, wherein the cathode of the first diode and the cathode of the second diode are connected to the second input node of the pixel circuit through the second resistive element, and wherein the storage capacitor and the first resistive element are serially connected between the first and second power supply nodes and are configured as an RC charging circuit to charge a voltage on the output node of the triode switch circuit when both the first and second diodes of the triode switch circuit are in a reversed-bias state.

6. The active matrix display system of claim 5, wherein the control circuit receives and processes a video signal, and outputs control signals to the scanning circuit and the hold circuit to drive the active-matrix pixel array and generate an image for each frame of image data in the video signal.

* * * * *